United States Patent [19]

Wirts et al.

[11] Patent Number: 4,591,110

[45] Date of Patent: May 27, 1986

[54] WIRE STORING AND DEREELING APPARATUS

[75] Inventors: Harold L. Wirts, Garrett; Horace B. Corner, Fort Wayne, both of Ind.

[73] Assignee: Mossberg Industries, Garrett, Ind.

[21] Appl. No.: 729,532

[22] Filed: May 2, 1985

Related U.S. Application Data

[63] Continuation of Ser. No. 634,958, Jul. 27, 1984.

[51] Int. Cl.[4] ..... B65H 49/08

[52] U.S. Cl. ..... 242/129.8; 206/389; 206/407; 220/298; 220/318; 220/379; 242/128; 242/137.1

[58] Field of Search ..... 242/54 R, 83, 128, 129.8, 242/137–138, 146, 170, 171; 206/403–409, 389; 220/298, 315, 318, 379

[56] References Cited

U.S. PATENT DOCUMENTS 3,001,642 9/1961 Hirst ..... 206/389

4,334,653 6/1982 Whellams ..... 242/129.8

4,451,014 5/1984 Kitt et al. ..... 242/128

*Primary Examiner*—Billy S. Taylor

*Attorney, Agent, or Firm*—Pearne, Gordon, Sessions, McCoy, Granger, & Tilberry

[57] ABSTRACT

A storage and dereeling apparatus is provided for storing and dispensing magnet wire or other reeled material. The storing and dereeling apparatus includes a container member in which a reel of magnet wire is placed with the axis thereof vertically disposed; and the apparatus includes a cover member. The cover member is automatically indexed to either of two rotational positions; and the cover member is releasably latched in a storage and transporting position wherein the cover member is adjacent to the spool of wire, to a preferred dereeling position wherein a space is provided intermediate of the reel of wire and the cover member to allow dereeling of the wire, and to an alternate dereeling position wherein the space between the reel of wire and the cover member is somewhat larger.

21 Claims, 10 Drawing Figures

WIRE STORING AND DEREELING APPARATUS

This is a continuation of application Ser. No. 634,958, filed July 27, 1984.

TECHNICAL FIELD

The present invention relates generally to storing and dereeling apparatus and more particularly, to a container member for storing and transporting magnet wire, which includes a cover member that is selectively latchable in a lower or storing position and in an upper or dereeling position.

BACKGROUND ART

A preferred method for storing, carrying, and dereeling magnet wire is to provide a container in which a one hundred pound reel of magnet wire may be placed, a bail and handle for carrying the pail, a cover for the container, a guide element in the center of the cover member for guiding the wire as it is spooled out of the container member, and to provide means for releasably latching the cover member in two positions.

In lower position, the cover substantially abuts the upper edge of the container adjacent to the top of the spool that contains the magnet wire; and in an upper position, a space exists between the upper edge and the wire spool that is sufficient to allow loop of wire to dereel between the spool and the cover.

A wire storing and dereeling apparatus as described above was disclosed in U.S. Pat. No. 4,451,014 of common assignee.

DISCLOSURE OF INVENTION

In the present invention, a container is provided which is generally cylindrical and includes an upper edge about an open top and a bottom that is closed. The container includes a first pair of indexing pads or portions that are disposed proximal to the upper edge, are diametrically disposed, and are generally displaced radially outward from the container periphery.

A cover is provided for the container. The cover includes a top that is generally planar and circular, a cylindrical flange integral with the top having a bottom edge, and extends telescopically over an upper part of the container.

The cover includes a second pair of diametrically opposed socket-like indexing portions of the flange that are generally displaced radially outward, are telescopically slidable over the first pair of indexing pads, and cooperate therewith to index the cover with respect to the container. The first pair of indexing pads includes a first pair of elongated, spaced, rib-like latching pawls that are parallel to each other, extend radially outward and circumferentially of the container, and are disposed proximal to the upper edge of the container. A second similar pair of latching pawls are provided on the same indexing pads and are displaced downwardly from the first pair.

The pair of socket-like indexing portions or sockets on the cover include a third pair of latching pawls similar to the aforementioned pawls that are parallel to each other, extend radially inward from respective ones of the sockets, are disposed proximal to the lower edge of the flange of the cover, are adapted latchingly to engage selectively the first and second pair of latching pawls to releasably latch the cover with a space intermediate the top of the cover and the upper edge of the container, or with the top of the cover substantially abutting the upper edge of the container.

BEST MODE FOR CARRYING OUT THE INVENTION

Figure 2:
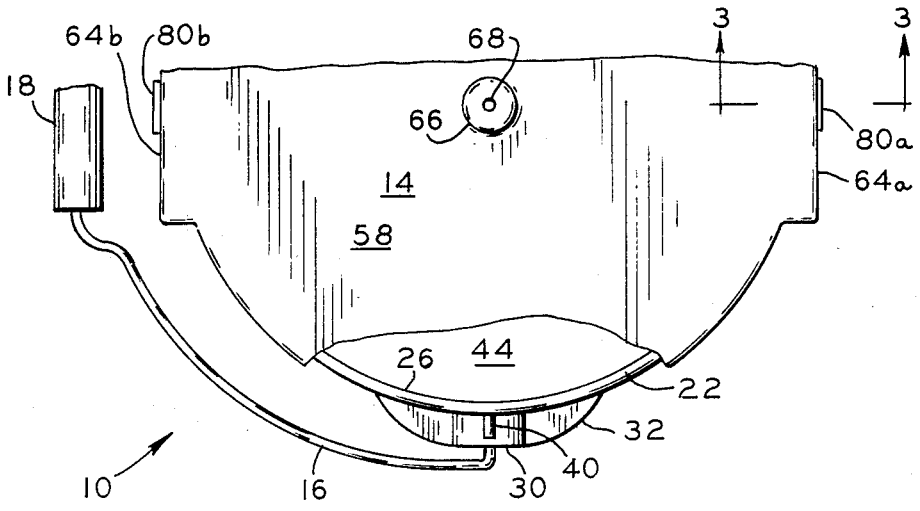
FIG. 2 is a partial top view of the embodiment of FIG. 1, taken substantially as shown by view line 2—2 of FIG. 1, and more completely showing a construction detail of the bail attaching boss by sectioning a portion of the cover member.
Figure 1:
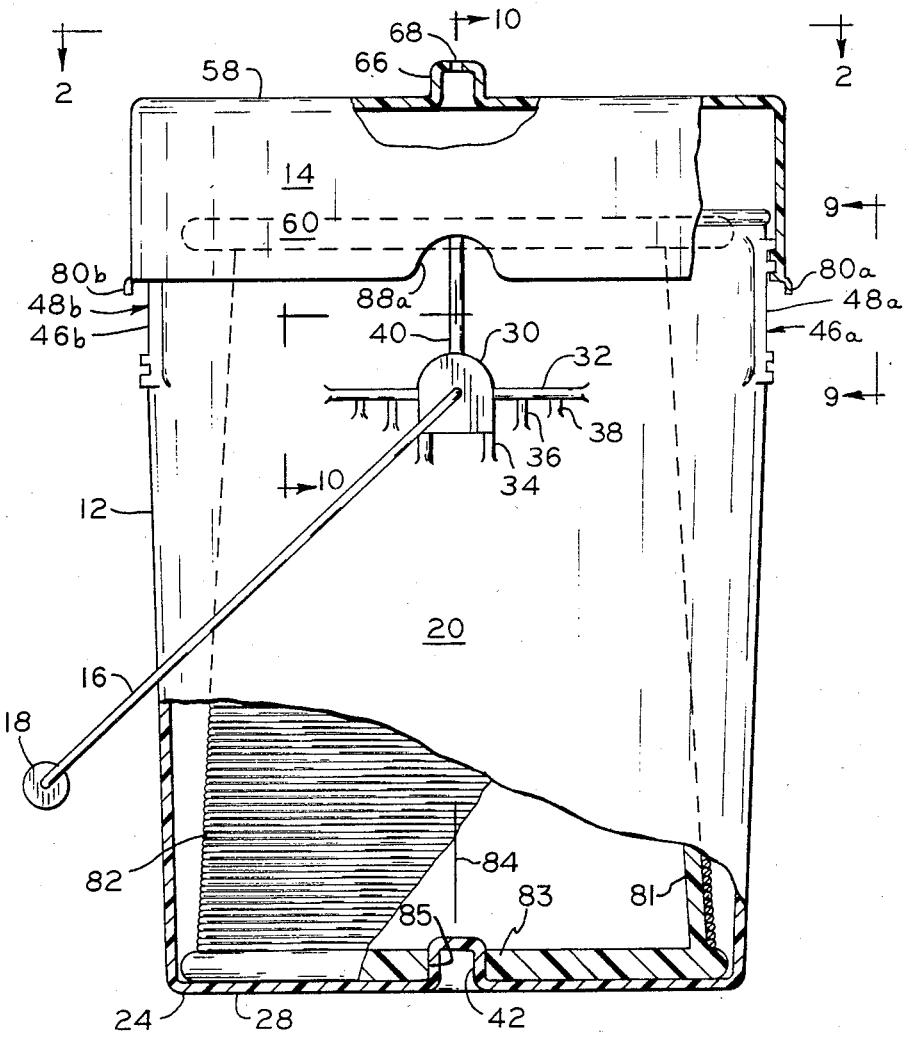
FIG. 1 is a front elevation of a preferred embodiment of the present invention, showing various details by sectioned portions thereof.

Referring now to FIGS. 1 and 2, a storing and dereeling apparatus 10 includes a container member 12 and cover member 14, both being molded of suitable plastic material, a bail 16, and a handle 18.

The container member 12 includes a container body 20 that is substantially cylindrical in shape and includes an upper edge 22 and a lower edge 24. The body 20 has an open top 26 defined by the upper edge 22 and a closed bottom proximal to the lower edge 24.

A bail attached boss 30 is integral with the container 20, a stiffening rib 32 is integral with the boss 30 and container 20 and is circumferentially disposed. Strengthening ribs 34 are integral with the boss 30 and container 20, and ribs 36 and 38 are integral with the stiffening ribs 32 and body 20 as shown.

The container 20 further includes a guide rib 40 that is integral therewith and extends from boss 30 to edge 22 and outwardly from the body 20. The bottom 28 of the container 20 includes a recess 42 that is centered and extends upwardly into the inside 44.

Figure 9:
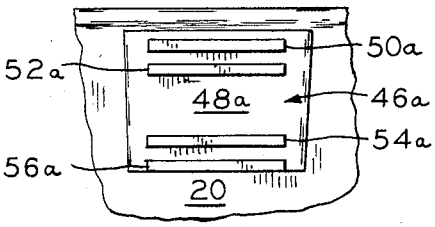
FIG. 9 is a partial side elevation of the container member taken substantially as shown by view line 9—9 of FIG. 1, and showing the indexing portions and the latching pawls thereof.
Figure 10:
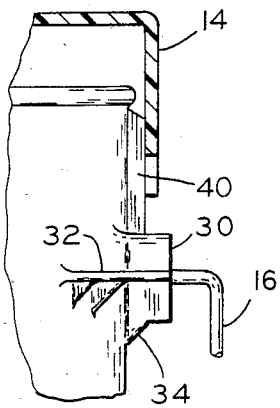
FIG. 10 is a partial and enlarged side elevation of the container member and a partial cross section of the cover member, taken substantially as shown by line 10—10 of FIG. 1.

Referring now to FIGS. 1, 3, 6 and 9, the container 20 includes indexing pads or portions 46*a* and 46*b* which are integrally molded on the body 20 as flat embossments which project radially therefrom. They are disposed diametrically opposite and preferably are identically shaped with straight side edges 74*a* and 74*b* which extend substantially axially of the container 20 (FIG. 9). Preferably, they are provided with outer, flat surfaces 48*a* and 48*b* which are also parallel to a tangent to the outer surface of container 20, these surfaces 48*a* and 48*b* also being parallel.

Two pairs of latching pawls 50*a*, 52*a* and 54*a*, 56*a* are provided on each of the surfaces 46*a* and 48*a*, respectively, these pawls being straight, elongated rib-like elements spaced apart and parallel and extending circumferentially of the container 20. The pawl pairs 50*a*, 52*a* on the two surfaces 46*a* and 48*a* are symetrically disposed in parallelism on diametrically opposite sides of the container 20 as are the pawls 54*a*, 56*a* on the two surfaces 46*a* and 48*a*. The two pawl pairs 50*a*, 52*a* and 54*a*, 56*a* are spaced apart axially of the container body 20 as shown.

Figure 3:
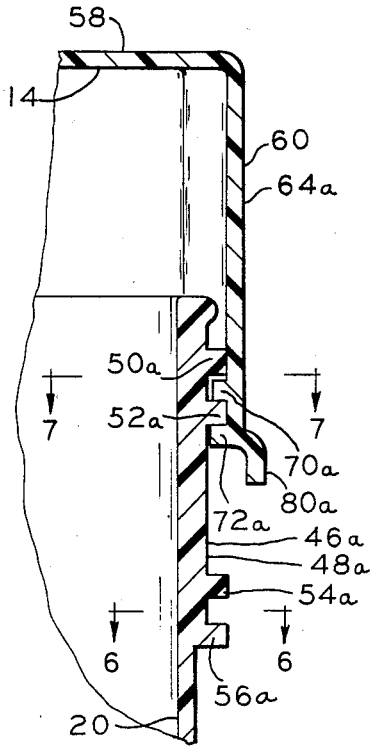
FIG. 3 is a partial and enlarged cross section, taken substantially as shown by section line 3—3 of FIG. 2, and showing the cover member releasably retained in a dereeling position.

Referring now to FIGS. 1–3, the cover member 14 includes a flat top 58, and an integral, cylindrical flange 60 having a bottom edge 62 and sized to telescopically fit over the body 20. The flange 60 is formed with two socket-shaped elements or indexing sockets 64*a* and 64*b* on diametrically opposite sides thereof which are internally shaped to fit over the indexing pads 46*a* and 46*b*, respectively. These socket-like elements 64*a* and 64*b* which may also be considered as indexing portions have generally straight sides 76*a* and 76*b* which are slightly spaced from but aligned with the straight sides 74*a* and 74*b* on the indexing pads 46*a* and 48*a*, respectively.

Formed integrally with the flange 60 and extending radially inwardly therefrom are two pairs of latching pawls 70*a* and 72*a* on the socket-like indexing portion 64*a* and 64*b*. These latching pawls 70*a* and 72*a* are straight, elongated, spaced apart elements quite like the pawl elements 50*a*, 52*a*, 54*a*, 56*a* (previously described) and also extend circumferentially of the container 20. These pawls 70*a* and 72*a*, however, are located near the bottom edge of the flange 60, the spacing between these pawls 70*a* and 72*a* being of a size just sufficient to receive therebetween one of the pawls 50*a*, 52*a*, 54*a*, 56*a*. In a working embodiment of this invention, the spacing between the pawls 50*a*, 52*a*, and 54*a*, 56*a* is made slightly smaller than that between the pawls 70*a* and 72*a*. The pawls 50*a*, 52*a*, 54*a* and 56*a* can be individually slidably received in the groove or space between the two pawls 70*a*, 72*a*, respectively. The pawls 70*a*, 72*a* may therefore be manipulated to lock over any selected one of the pawls 50*a*, 52*a*, 54*a*, 56*a* by reason of the socket-like indexing portions 64*a*, 64*b* being resiliently preformed to be positioned radially inwardly sufficiently to engage the pawls on the container 20.

With the cover 14 fitted over the container 20 the cover 14 is held against rotational movement by reason of the juxtaposition of the respective sides 74*a*, 76*a* and 74*b*, 76*b* on the indexing pads and the socket portion respectively.

Extending downwardly from the two socket portions 64*a* and 64*b* are two flange extensions or manipulating tabs 80*a* and 80*b*, these being displaced outwardly slightly as shown to be conveniently accessible.

Projecting upwardly, centrally of the cover top 58 is a bushing projection 66 having a hold 68 in the center for receiving a strand of wire therethrough in a conventional manner. The indentation 42 centrally of the container bottom 28 is adapted to slidably receive the bushing projection 66. Several containers with covers in place may thereby be stacked one upon the other and also provide a measure of stability in handling and shipping.

Figure 4:
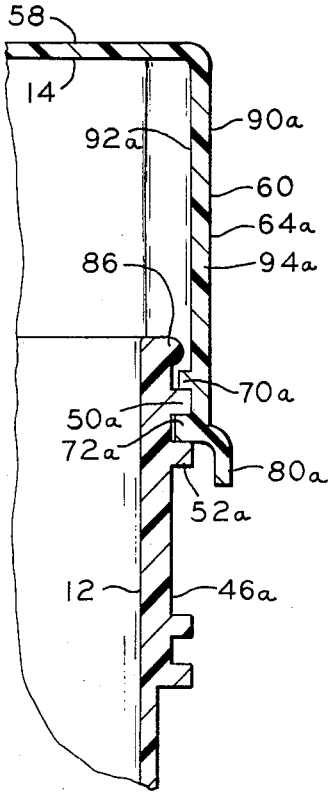
FIG. 4 is a partial and enlarged cross section taken substantially the same as FIG. 3, but showing the cover member releasably retained in an alternate dereeling position.
Figure 5:
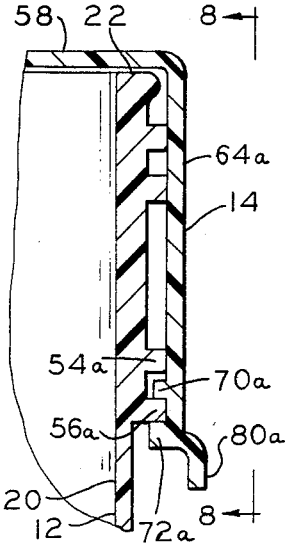
FIG. 5 is a partial and enlarged cross section taken substantially the same as FIGS. 3 and 4, but showing the cover member is a storage and transporting position.
Figure 6:
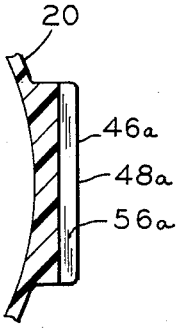
FIG. 6 is a partial and enlarged cross section taken substantially as shown by section line 6—6 of FIG. 3, and showing a cross section of one of the indexing portions of the container member.
Figure 7:
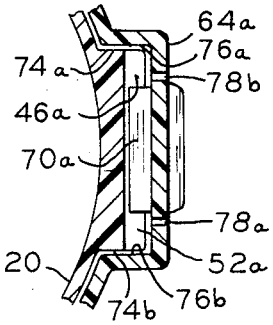
FIG. 7 is a partial and enlarged cross section taken substantially as shown by section line 7—7 of FIG. 3, and showing a cross section of one of the indexing portions of both the container member and the cover member.

Referring now to FIGS. 1–5, the cover 14 may be released from the position of FIG. 5 by pulling outwardly on the release tabs 80*a* and 80*b* to disengage latching pawls 56*a*. Cover 14 may be raised on container 20 and locked in two different other positions as shown in FIGS. 3 and 4. The preferred dereeling position is shown in FIG. 3 wherein the cover 14 is retained from falling downwardly by the latching pawl 70*a* fitting into the detent space between the two pawls 50*a* and 52*a* and being pulled upwardly by the force of wire being pulled through the hole 68.

As shown in FIG. 3, the latching pawl 70*a* is shorter, that is, it projects inwardly a shorter distance than the latching pawl 72*a*. While the primary purpose is to permit part removal from the mold, it also allows the pawl 70*a* to move upwardly past the pawl 52*a* with a given deflection outwardly of the release tabs 80*a* and 80*b*; but to prevent accidentally raising the pawl 72*a* above the pawl 52*a*.

However, in the event that the user deflects the release tabs 80*a* and 80*b* outwardly far enough to allow the pawl 72*a* to move above the pawl 52*a*, then the alternate dereeling position of the cover member 14, as shown in FIG. 4, may be used.

In the alternate dereeling position of FIG. 4, the pawl 70*a* is disposed intermediate of the pawl 50*a* and a rim, or bead, 86 of the container 20 and the cover 14 is locked into position by the pawl 72*a* resiliently fitting into the detent space between pawls 50*a* and 52*a*.

In operation, assuming that the cover 14 is removed from the container 20, the cover 14 is grasped in both hands and placed over the edge 22 with the socket portions 64*a* and 64*b* being aligned with the indexing pads 46*a* and 48*a*. The tabs 80*a* and 80*b* are grasped with the fingers and drawn outwardly far enough such that the pawls 70*a* and 72*a* will just clear the pawls 50*a*, 52*a*, 54*a* and 56*a* on the container body 20. The cover 14 is then lowered to one of the three desired positions of FIGS. 3, 4 and 5. In this position, the tabs 80*a* and 80*b* are released whereupon the resilience of that portion of the cover which directly supports the two pawls 70*a* and 72*a* springs these pawls inwardly until the space therebetween forcefully fits over a selected one of the pawls 50*a*, 52*a*, 54*a* and 56*a*. This spring force is facilitated by means of two slots 78*a* and 78*b* (FIG. 8) formed in the socket portions 64*a* and 64*b*. Preferably the container 20 and the cover 14 are molded of a suitable plastic having the desired strength and resiliency properties.

When the tabs 80*a* and 80*b* are pulled outwardly, these naturally tend to flatten or distort the flange 60 along the sides corresponding to the locations of the two bail embossments 30. This is resisted by means of the ribs 40 which are located immediately adjacent to the thick embossments 30. When the cover 14 is moved to its lowermost position as shown in FIG. 5, the cutouts 88*a* will fit over the embossments 30 in conforming engagement therewith and the adjacent edge portion 62 will rest on the ledges 32 molded integrally with the respective embossments 30. These cutouts 88*a* are so positioned with respect to the socket portions 64*a* and 64*b* that once the latter are aligned with the indexing pads 46*a* and 48*a*, the cutouts 88*a* will be aligned with the respective embossments 30. Thus, it is not necessary to line up any portion of the cover 14 with any portion of the bail assembly prior to installing the cover 14. The fit of the cutouts 88*a* with the respective embossments 30 also serve to further index the cover 14 on the container and to hold the cover 14 against accidental rotational displacement.

The guide ribs 40 engage the flange 60 of the cover member 14 to maintain roundness of the flange 60, and thereby to provide a force on the flange 60 that assists in engaging the latching pawls 70*a* and 72*a* of the cover member 14 with various ones of the latching pawls, 50*a*, 52*a* and 54*a* and 56*a* of the container 12.

Figure 8:
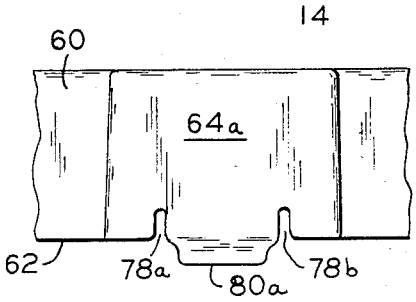
FIG. 8 is as partial side elevation of the cover member, taken substantially as shown by view line 8—8 of FIG. 5, and showing both a release tab and the resiliency slots that are disposed on opposite sides of the release tab.

Referring to FIG. 8, the resiliency slots 78*a* and 78*b* in cooperation with the wall section 94*a* provide an imaginary hinge line which extends between the inner ends of these slots and in part control the force that is required to disengage the latching pawls, 70*a* and 70*b*, of the cover 14 from the latching pawls, 50*a*, etc. of the container 12.

Referring to FIG. 4, the indexing socket 64*a* includes a planar outer surface 90*a* and a planar inner surface 92*a*. These planar surfaces define a flatwall 94*a* which provides greater resilience than curved walls of the prior art. The flat wall 94*a* cooperates with the slots 78*a*, 78*b* to provide the desired resiliency.

In summary, a storing and dereeling apparatus has been provided in which indexing means is provided to automatically key latching pawls into alignment and to provide indexing of bail receiving cutouts with the bail attaching bosses; the cover member 14 is releasably latched into a storage position and dereeling position by pulling outwardly on two releasing tabs. Further, the upper pawl of each pair on the cover is shorter than the lower pawl of such pair to assist raising the cover member to the first dereeling position, and to prevent the cover form being raised thereabove. A second dereeling position, in which the cover is raised above the first dereeling position, is provided for convenience, if a user should accidentally raise the cover above the first dereeling position.

The resiliency of releasing the latching pawls is controlled by providing a flat wall for mounting the latching pawls on the cover; and resiliency slots are included on both sides of the latching pawls of the cover to increase the resiliency of the portion to which these pawls are attached. This double control of resiliency assists in providing reliable latching, reliable releasing of latches, reliable locating of the cover member to the first dereeling position, and durability of the latching function.

Finally, the cover 14 may be easily adjusted by a simple manual manipulation consisting merely of grasping the cover 14 at the socket portions 64*a* and 64*b*, then by means of the fingers manipulating further the tabs 80*a* and 80*b* while raising or lowering the cover 14. This contrasts with other prior art devices in which it is necessary to first release one part and then another in sequence before the cover can either be removed or adjusted. If such sequential manipulation is not desired, such prior devices may be grasped in a cumbersome manner somewhat in the form of wrapping the arms about the cover to raise or lower it while at the same time using the hands to manipulate the detent locking devices.

Summarizing and in further explanation, apparatus 10 serves the purpose of not only transporting and storing a spool of wire 82 but also serves as a dereeling apparatus. The spool and wire thereon are conventional, the spool itself including a barrel and two end flanges, FIG. 1 illustrating the barrel 81 and one end flange 83. The end flange 83 is conventionally provided with an arbor receiving hole 85 centrally thereof.

As a part of this invention, the boss 42 is cylindrically shaped and made to a size as to have a sliding interference fit with the cylindrical, arbor-receiving hole 85. The purpose of this fit will be explained later.

With the spool assembly 82 in position within the pail and the locating boss 42 snugly fitted into the hole 85, the end coil of wire from the reel 82 is threaded through the hole 68 as previously explained. The cover 14 is positioned as shown in FIGS. 1, 3 or 4. As wire is drawn from the pail, the wire passes the upper flange on the spool asssembly 82 in a conventional manner and as otherwise explained in detail in prior U.S. Pat. No. 4,451,014. With the cover 14 in its dereeling position, the cover flange 60 serves as an upward extension of the container 20 itself such that a strand of wire being unreeled is prevented from being thrown radially outwardly beyond the container sidewall. When the strand of wire has been completely dereeled from the spool, the cover 14 is removing along with the spool, wire is rewound on the spool or a new wire-wound spool 82 is placed within container 20 and cover 14 is replaced over the open top of the container is closed position as shown in FIG. 5. The container apparatus with the spool installed is thus ready for transporting.

The significance of the tight fit between the locating boss 42 and the arbor-receiving hole 85 is that during dereeling, a strand naturally engages the perimeter of the upper, disc-shaped flange subjecting it to a lateral force tending to tip the spool assembly 82 from its upright position as shown. Any tiping of the spool assembly 82 within the container 20 is disadvantageous, since during dereeling, this could result in the wire becoming entangled and possibly breaking. By reason of the tight fit between the boss 42 and the arbor-receiving hole 84 the spool assembly 82 is prevented from tipping within the container 20.

It has previously been explained that the cover 14 and contained 20 are each individually molded of a suitable plastic. Preferably, this material when molded is impervious to the solvents and other materials used in wire operations, such as motor winding, coil winding and the like. Such plastic material in the present instance is, therefore, preferably high density polyethylene. Another advantage residing in this particular plastic material is that inherently it is somewhat lubricous thereby aiding in the ease of wire passing through the hole 68 in the cover 14.

While specific apparatus has been shown and described, many variations of the present invention will become apparent from reading the preceding specification; therefore, the scope of the present invention is to be determined from the claims that are appended hereto.

INDUSTRIAL APPLICABILITY

The storing and dereeling apparatus of the present invention is applicable to the electrical motor and magnet industry in which magnet wire is dereeled and wound onto various electromagnetic devices.

Further, the storing and dereeling apparatus of the present invention is applicable to any industrial operation in which a wire, a cord, a rope, or such, is dispensed from a spool or reel.

We claim:

1. Apparatus for storing and dereeling wire on a spool with the axis thereof upright, which apparatus comprises:

a cylindrical container having an open top surrounded by an upper annular edge;

a first indexing portion comprising a portion of said container that is disposed proximal to said upper edge of said container, the first indexing portion including a pair of embossments diametrically disposed and projecting radially outwardly from the container;

a cover having a top and an integral cylindrical flange telescopically slidable over the upper portion of said container;

a second indexing portion comprising a portion of said flange that cooperates with said first indexing portion to index said cover rotationally with respect to said container;

said cover being receivable over said container only upon alignment and operative engagement of said first and second indexing portions, said cover being movable on said container while said first and second indexing portions are so aligned and engaged between a closed position and a dereeling position wherein a midportion of said cover is spaced above said spool a predetermined distance;

means on diametrically opposite sides of said container and said flange for removably securing said cover in a selected one of said closed and dereeling portions, the means on the container diametrically opposite sides being associated with the embossments of the first indexing portion; and means for maintaining the roundness of said flange while it is being manipulated between said positions.

2. The apparatus of claim 1 wherein each embossment has spaced apart side edges which extend generally parallel to the axis of said container, said second indexing portion also including side edges juxtaposed in guiding relation with the first-mentioned side edges thereby to prevent relative rotation between said cover and said container.

3. The apparatus of claim 2 wherein said means for maintaining the roundness of said flange includes a spacing element on said container which extends radially outwardly therefrom and is slidably engageable with said flange while said cover is being moved between said two positions.

4. The apparatus of claim 3 wherein said spacing element is in the form of a rib extending generally parallel to the axis of said container and is circumferentially spaced from said securing means.

5. The apparatus of claim 2 wherein there are two socket-shaped elements integrally formed on said flange on diametrically opposite sides thereof, said socket-shaped elements slidably receiving said two embossments, respectively, and said securing means being conjointly carried by both said embossments and socket-shaped elements.

6. The apparatus of claim 5 wherein said securing means includes detent spaces on one of said embossments and socket-shaped elements and pawl members on the other, said pawl members being engageable with said detent spaces, respectively, to secure said cover in position.

7. The apparatus of claim 6 wherein said detent spaces and said pawl members are straight and elongated and extending generally circumferentially of said container.

8. Apparatus for storing and dereeling wire on a spool with the axis thereof upright, which apparatus comprises:

a cylindrical container having an open top surrounded by an upper annular edge;

a first indexing portion comprising a portion of said container that is disposed slightly below and proximal to said upper edge of said container;

a cover having a top and an integral cylindrical flange telescopically slidable over the upper portion of said container;

a second indexing portion comprising a portion of said flange that cooperates with said first indexing portion to index said cover rotationally with respect to said container;

said cover being receivable over said container only upon alignment and operative engagement of said first and second indexing portions, said cover being movable on said container while said first and second indexing portions are so aligned and engaged begween a closed position and a dereeling position wherein a midportion of said cover is spaced above said spool a predetermined distance;

means on diametrically opposite sides of said container and said flange for removably securing said cover in a selected one of said closed and dereeling portions, said first indexing portion being in the form of an embossment on said container which projects radially outwardly therefrom, said embossment having spaced apart side edges which extend generally parallel to the axis of said container, said second indexing portion also including side edges juxtaposed in guiding relation with the first-mentioned side edges thereby to prevent relative rotation between said cover and said container.

9. The apparatus of claim 8 wherein there are two of said embossments diametrically disposed and which form a part of said securing means, two socket-shaped elements integrally formed on said flange on diametrically opposite sides thereof, said socket-shaped elements slidably receiving said two embossments, respectively, and said securing means being conjointly carried by both said embossments and socket-shaped elements.

10. The apparatus of claim 9 wherein said securing means includes detent spaces on one of said embossments and socket-shaped elements and pawl members on the other, said pawl members being engageable with said detent spaces, respectively, to secure said cover in position.

11. The apparatus of claim 10 wherein said detent spaces and said pawl members are straight and elongated and extending generally circumferentially of said container.

12. The apparatus of claim 10 wherein said embossments are flat and tangentially related to said containers, said socket-shaped elements being disposed in said flange to receive said embossments therein, said guiding edges of said second indexing portion being a part of said socket-shaped elements.

13. The apparatus of claim 12 wherein each said embossment has a flat outer surface and two pairs of pawl elements thereon, said pairs being spaced axially of said container and parallel, the pawl members of each pair being parallel and spaced to provide detent spaces, each said socket-shaped element having two pawl members on the inner side near the bottom edge thereof and which are spaced apart to provide a detent space therebetween.

14. The apparatus of claim 13 wherein said upper edge of said container includes a radially outwardly extending rib adapted to be engaged by the detent space on said socket-shaped elements.

15. The apparatus of claim 13 wherein said socket-shaped elements each have circumferentially spaced notches therein which provide a resilient hinge line above the two pawl members thereon, said last-mentioned pawl members being supported by resilient material pre-formed to cause engagement of these pawl members with the detent spaces on said embossment.

16. Apparatus for storing and dereeling wire on a spool disposed with the axis thereof upright, comprising:

a container having an open top and adapted to receive said spool therein, a cover being receivable over said open top of said container, said container being movable on said container between a closed position and a dereeling position wherein a midportion of said cover is spaced above said spool a predetermined distance, locking means on one of said container and said cover to removably secure said cover in either said dereeling or closed positions, said locking means including a diametrically opposed pair of resilient sections of said cover which are preformed to secure said cover in a selected one of said dereeling or closed positions.

17. The apparatus of claim 16 wherein said locking means includes cooperatively engageable pawls and detent spaces on diametrically opposite sides of said container and cover, said resilient section carrying one of said pawls and detent spaces and being flexible in a direction to disengage the pawl from the detent section, said detent section further being part of the flange on said cover and provided with axially extending notches which facilitate the flexing of said resilient section.

18. Apparatus for storing and dereeling wire on a spool disposed with the axis thereof upright, comprising:

a container having an open top and adapted to receive said spool thereon, a cover being receivable over said open top of said container, said cover being movable on said container between a closed position and a dereeling position wherein a midportion of said cover is spaced above said spool a predetermined distance, locking means on one of said container and said cover to removably secure said cover in either said dereeling or closed positions, a bail assembly operatively secured to said container, said assembly including two diametrically opposed embossments on said container, reinforcing ribs for said container, two ribs extending circumferentially of said container from each of said embossments and being integrally joined to said container and respective embossements, another set of two ribs extending axially of said container from said two embossments, respectively, to the upper edge of said container, said other ribs being integrally joined to the respective embossments and container.

19. The apparatus of claim 18 wherein said cover has a cylindrical flange which receives the upper portion of said container in slidable engaging relation, said flange being engageable with said other two ribs thereby being spaced from the wall of said container, said locking means being in two portions on diametrically opposite sides of said container and cover, respectively, and orthogonally related to said other two ribs, said flange at said diametrically opposite sides being resiliently flexible outwardly thereby to release said locking means.

20. Apparatus for storing and dereeling wire on a spool disposed with the axis thereof upright, comprising:

a container having an open top and adapted to receive said spool thereon, a cover being receivable over said open top of said container, said cover being movable on said container between a closed position and a dereeling position wherein a midportion of said cover is spaced above said spool a predetermined distance, locking means on one of said container and said cover to removably secure said cover in either said dereeling or closed positions, said cover having a wire-receiving opening centrally thereof, said container having a closed bottom provided with an upstanding boss centrally thereof, a spool of wire fitted into said container, the spool having two flanges secured to the opposite ends of a barrel, one of said flanges having a centrally located arbor-receiving hole therein which slidably fits snugly over said boss thereby to inhibit said spool from tipping relative to said container.

21. The apparatus of claim 20 wherein said one flange is disc-shaped with the hole being coaxial therein, said container bottom also being disc-shaped with said boss being coaxial thereof, said one flange resting flat against said bottom when said boss fits into said hole.

* * * * *